US005908820A

United States Patent [19]

Oakes et al.

[11] Patent Number: 5,908,820

[45] Date of Patent: Jun. 1, 1999

[54] PEROXYACIDS

[75] Inventors: John Oakes; David William Thornthwaite, both of Bebington, United Kingdom

[73] Assignee: Lever Brothers Company, New York, N.Y.

[21] Appl. No.: 08/738,504

[22] Filed: Oct. 24, 1996

[30] Foreign Application Priority Data

Oct. 30, 1995 [EP] European Pat. Off. ..... 95307730

[51] Int. Cl.[6] ..... C07C 409/24; C11D 3/395; C11D 7/54

[52] U.S. Cl. ..... 510/310; 510/375; 510/504; 252/186.42; 562/2

[58] Field of Search ..... 510/310, 375, 510/504, 513; 252/186.1, 186.42; 562/2

[56] References Cited

U.S. PATENT DOCUMENTS

| | | | |
|---|---|---|---|
| 5,106,528 | 4/1992 | Francis et al. | 252/186.23 |
| 5,117,049 | 5/1992 | Venturello et al. | 562/2 |

FOREIGN PATENT DOCUMENTS

| | | |
|---|---|---|
| 0 316 809 | 5/1989 | European Pat. Off. . |
| 64-56797 | 3/1989 | Japan . |
| 3-199298 | 8/1991 | Japan . |
| 4-91075 | 3/1992 | Japan . |
| 5-194955 | 8/1993 | Japan . |

OTHER PUBLICATIONS

JP 04 91,075 (English languge synopsis enclosed): Chemical Abstracts vol. 117, No. 11, Abstract No. 111261q, Mar. 1992.

JP 01 56,797 (English language synopsis enclosed): Chemical Abstracts vol. 111, No. 20, Abstract No. 176804q, Mar. 1989.

JP 03 199,298 (English languge synopsis enclosed): Chemical Abstracts vol. 116, No. 10, Abstract No. 086291u, Aug. 1991.

English language translation of JP 64056797, Kao Corp., Mar. 1989.

English language translation of JP 05–194995, Kao Corp., Aug. 1983.

English language translation of JP 03199298, Kao Corp., Aug. 1991.

English language translation of JP 04091075, Kao Corp., Mar. 1992.

*Primary Examiner*—Douglas J. McGinty
*Assistant Examiner*—Caroline L. Dusheck
*Attorney, Agent, or Firm*—Milton L. Honig

[57] ABSTRACT

There is provided a cationic organic peroxyacid having the general formula

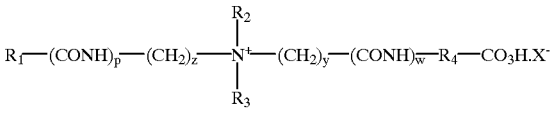

wherein:

$R_1$ is an optionally substituted, linear or branched, $C_8$–$C_{12}$ alkyl or alkenyl group; $R_2$ and $R_3$ are each a methyl group; $R_4$ is an optionally substituted, linear or branched $C_3$–$C_5$ alkyl or alkenyl group; p is 0 or 1; z is an integer selected from 0–3; y is an integer selected from 0–5; w is 0 or 1; and $X^-$ is a counter anion. This peroxyacid was found to have good bleaching performance without showing incompatibility with anionic surfactants.

9 Claims, No Drawings

PEROXYACIDS

FIELD OF THE INVENTION

The present invention relates to cationic peroxyacids and to compositions including these peroxyacids as bleaches, in particular detergent compositions used for washing fabrics.

BACKGROUND OF THE INVENTION

It is well known that organic peroxyacids can be used as bleaching agents in detergent compositions Many different types of organic peroxyacids have been proposed such as peroxybenzoic acid, peroxyphthalic acid, peroxyalkanoic acid and diperoxyalkanedioic acids, described in U.S. Pat. Nos. 4,110,095, 4,170,453, and 4,325,828. Other classes of peroxy acids which have been disclosed include amidoperoxyacids which contain a polar amide linkage part way along a hydrocarbon chain (U.S. Pat. Nos. 4,634,551 and 4,686,063) and phthalimido-substituted peroxyalkanoic acids (EP-A-325,288).

There is now an increasing interest in cationic organic peroxyacids, particularly for use in bleaching and detergent compositions, since, when compared to their non-cationic counterparts, they (i) are more substantive;

(ii) have a better bleaching performance; and (iii) are pH-robust.

A range of peroxyacids comprising a quaternary ammonium group is described in Japanese patent application JP4-91075 (KAO). In particular, this document discloses a range of materials of formula

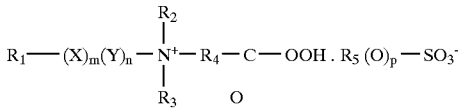

wherein:

$R_1$ is an optionally substituted, linear or branched, $C_1$–$C_{20}$ alkyl or alkenyl group or an unsubstituted or $C_1$–$C_{20}$ alkyl-substituted aryl group;

X and Y represent various groups;

$R_2$ is an optionally substituted $C_1$–$C_{10}$ alkyl group;

$R_3$ is an optionally substituted $C_1$–$C_3$ alkyl group;

$R_4$ is an optionally substituted alkylene group,

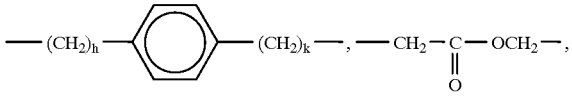

or 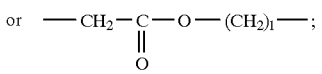

h and k are integers from 0 to 3;

1 is an integer from 1 to 10;

$R_5$ is a $C_2$–$C_{20}$ alkyl group, alkenyl group or alkyl-substituted or unsubstituted aryl group; and m, n, and p are 0 or 1.

It can be seen that the cationic peroxyacids disclosed by this Japanese application contain a sulphonate as counter anion. Furthermore, in the Examples of this Japanese document a peroxyacid is disclosed having the following formula

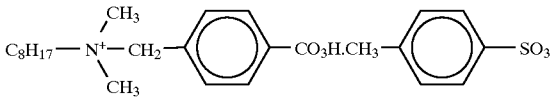

A disadvantage of this type of materials is that they may give rise to negative interactions with surface-active materials, especially anionic surfactants, (eg. precipitation) leading to loss of peroxyacid and a poorer bleach performance. Furthermore, it was found that local dye damage may result when coloured fabric is treated with this type of peroxyacid. It was also found that this type of peroxyacids can only be produced at relatively poor yields, typically ranging from 11–55% by weight.

We have now found a related group of peroxyacid compounds containing, as an $R_4$-group, a linear or branched $C_3$–$C_5$ alkyl or alkenyl group, which compounds were found to have good bleach activity without showing any incompatibility with anionic surfactants.

SUMMARY OF THE INVENTION

The present invention provides a cationic organic peroxyacid having the general formula (I)

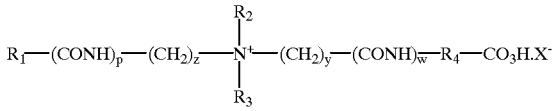

wherein:

$R_1$ is an optionally substituted, linear or branched, $C_8$–$C_{12}$ alkyl or alkenyl group;

$R_2$ and $R_3$ are each a methyl group;

$R_4$ is an optionally substituted, linear or branched $C_3$–$C_5$ alkyl or alkenyl group;

p is 0 or 1; z is an integer selected from 0–3;

y is an integer selected from 0–5; w is 0 or 1; and $X^-$ is a counter anion.

The invention also provides a bleaching detergent composition, comprising from 3 to 40% by weight of one or more surface-active compounds, from 5 to 80% by weight of one or more detergency builders and an effective amount of a cationic peroxyacid according to the present invention, as the bleach component.

The term "effective amount", as used herein, means that the cationic peroxyacid is present in a quantity such that it is operative for its intended purpose, i.e as a bleaching agent, when the detergent composition is combined with water to form an aqueous medium which may be used to wash and clean clothes, fabrics and other articles. Preferably, the cationic peroxyacids of the present invention, when present as the bleach component, will be present in bleaching detergent compositions in amounts of from 0.5 to 15% by weight, more preferably from 2 to 10% by weight.

According to a third aspect, the present invention a bleaching additive composition comprising from 50 to 90% by weight of a cationic peroxyacid according to the present invention, as the bleach component.

DETAILED DESCRIPTION OF THE INVENTION

In addition to the advantages mentioned above, the peroxyacids of the present invention were found to be highly weight effective (caused by their relatively low molecular weight) and readily biodegradable. Another advantage of the peroxy acids according to the present invention is that the route by which these materials are made is simple since it involves readily available starting materials.

It is further noted that compounds according to the above formula I but having an $R_1$-group of which the chain length is higher than $C_{12}$, were observed to show drastically increased incompatibility with anionic surfactants, resulting in reduced bleaching activity. On the other hand, the risk of local dye damage is increased when using compounds of formula I but having an $R_1$-group of which the chain length is lower than $C_8$.

Preferred cationic peroxyacids of the present invention are those in the formula of which p, z, y, and w are all zero ( see the above-shown general formula I).

These preferred cationic peroxyacid may be readily prepared by reacting 6-bromo-hexanoic acid with an acid catalyst in methanol to form its methyl ester and subsequently by reacting said ester in methanol with dimethylamine to form the 6-dimethyl ammonium ester. This aminoester can be readily quaternised with the appropriate alkyl halide or tosylate to give the quaternary ammonium ester. This ester is subsequently hydrolysed with strong acid to form a quaternary acid which is then peroxidised using hydrogen peroxide and methane sulphonic acid (or another strong acid source) to yield the desired quaternary peroxy acid.

For scaling-up of the process for making cationic peroxyacids of the invention, the following process may be more attractive, since the starting material is relatvely cheap and less process steps are involved. In this process, caprolactam is ring-opened by hydrolysis to form the corresponding 6-amino hexanoic acid which is then methylated using formic acid and formaldehyde to give 6-dimethylaminoacid. This acid is quaternised and peroxidised to yield the desired quaternary peroxyacid.

In the peroxyacids of the present invention, $R_1$ is preferably an unsubstituted linear $C_8$–$C_{12}$ alkyl group. Reason is that, in that case, compatibility of the peroxy acids with anionic surfactants is ensured. In order to obtain minimal local dye damage when these peroxyacids are used, as bleach component, in detergent compositions for washing of coloured fabric, $R_4$ is preferably an unsubstituted linear $C_3$–$C_5$ alkyl group, more preferably an unsubstituted linear $C_5$ alkyl group.

$X^-$ may be any suitable counter anion, particularly $NO_3^-$, $HSO_4^-$, $SO_4^{2-}$, $CH_3SO_4^-$, and $R_5$—$(O)_p$—$SO_3^-$, wherein $R_5$ is a $C_2$–$C_{20}$ alkyl group, alkenyl group, or alkyl substituted or unsubstituted aryl group, and p is 0 or 1. The best bleaching results were obtained when using peroxyacids according to the invention, having a counter anion selected from sodium dodecyl sulphate (SDS), sodium fatty acid alpha sulphonate (SFAS) and tosylat, especially SDS and tosylate.

The peroxyacids of the present invention may find use in a wide range of industrial applications and processes, for example in the field of plastics as polymerisation initiators, or as oxidants for olefin epoxidation, or as bleaching agents in the paper industry. They are also particularly useful as bleaching or cleaning agents in washing, cleaning and disinfecting compositions, such as laundry bleaches, hard surface cleaners, toilet bowl cleansers, automatic dishwashing compositions, denture cleaners and other sanitizing compositions.

The cationic peroxyacids of the present invention find particular application in detergent compositions since they show good bleach performance at medium to low washing temperatures, that is 60 to 20° C. This means that detergent compositions containing such peroxyacids may readily be used at the medium to low wash temperatures which are becoming increasingly common.

Surfactants

The bleaching detergent compositions of the invention will contain at least one surface-active compound, which may be anionic, cationic, nonionic or amphoteric in character, present in an amount from about 3 to about 40%, preferably from 5 to 35% by weight.

Generally, mixtures of the above surface-active compounds are used. In particular, mixtures of anionic and nonionic surface-active compounds are commonly used. Amounts of amphoteric or zwitterionic surface-active compounds may also be used but this is not generally desired owing to their relatively high cost. If used, they will be present in small amounts.

The surface-active material may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch.

Synthetic anionic surfactants are well known to those skilled in the art. Examples include alkylbenzene sulphonates, particularly sodium linear alkylbenzene sulphonates having an alkyl chain length of $C_8$–$C_{15}$; primary ($C_{12-15}$) and secondary alkyl sulphates ($C_{14-18}$), particularly sodium $C_{12-15}$ primary alcohol sulphates; olefin sulphonates; alkane sulphonates; dialkyl sulphosuccinates; and fatty acid ester sulphonates.

It may also be desirable to include one or more soaps of fatty acids. These are preferably sodium soaps derived from naturally occurring fatty acids, for example, the fatty acids from coconut oil, beef tallow, sunflower or hardened rapeseed oil. Soaps may be incorporated in the compositions of the invention, preferably at a level of less than 25% by weight. They are particularly useful at low levels in binary (soap/anionic) or ternary mixtures together with nonionic or mixed synthetic anionic and nonionic compounds. Soaps which may be used are preferably the sodium, or, less desirably, potassium salts of saturated or unsaturated $C_{10}$–$C_{24}$ fatty acids or mixtures thereof. Typically such soaps may be present at levels between about 0.5% and about 25% by weight, with lower levels of between about 0.5% to about 5% being generally sufficient for lather control. If the soap is present at a level between about 2% and about 20%, particularly between about 5% and about 10%, this can give beneficial detergency effects. The inclusion of soap is particularly valuable in detergent compositions to be used in hard water since the soap acts as a supplementary builder.

The preferred anionic surfactant is sodium $C_{12-15}$ primary alcohol sulphate.

Suitable nonionic detergent compounds which may be used include the reaction products of compounds having a hydrophobic group and a reactive hydrogen atom, for example, aliphatic alcohols, acids, amides or alkyl phenols with alkylene oxides, especially ethylene oxide either alone or with propylene oxide.

Specific nonionic detergent compounds are alkyl ($C_{6-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylenediamine. Other so-called nonionic detergent compounds include long-chain tertiary amine oxides and tertiary phosphine oxides.

Further suitable nonionic surfactants are alkyl polyglycosides of general formula $R_4O(R_5O)_t(G)_y$ in which $R_4$ is an organic hydrophobic residue containing 10 to 20 carbon atoms, $R_5$ contains 2 to 4 carbon atoms, G is a saccharide residue containing 5 to 6 carbon atoms, t is in the range 0 to 25 and y is in the range from 1 to 10. Alkyl polyglycosides of formula $R_4O\ (G)_y$, ie. a formula as given above in which t is zero, are available from Horizon Chemical Co.

Other suitable nonionic surfactants include O-alkanoyl glucosides described in International Patent Application WO 88/10147 (Novo Industri A/S). Further possible hydrophobic nonionic surfactants are monoglyceryl ethers or esters of the respective formulae

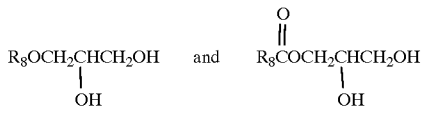

$R_8$ is preferably a saturated or unsaturated aliphatic residue.

The monoglyceryl ethers of alkanols are known materials and can be prepared, for example by the condensation of a higher alkanol and glycidol. Glycerol monoesters are of course well known and available from various suppliers including Alkyril Chemicals Inc.

Detergency Builders

The bleaching detergent composition of the invention will generally contain one or more detergency builders, suitably in an amount of from 5 to 80 wt %, preferably from 20 to 80 wt %. This may be any material capable of reducing the level of free calcium ions in the wash liquor and will preferably provide the compositions with other beneficial properties such as the generation of an alkaline pH and the suspension of soil removed from the fabric.

Preferred builders include alkali metal (preferably sodium) aluminosilicates, which may suitably be incorporated in amounts of from 5 to 60% by weight (anhydrous basis) of the composition, and may be either crystalline or amorphous or mixtures thereof.

Examples of phosphorus-containing inorganic detergency builders include the water-soluble salts, especially alkali metal pyrophosphates, orthophosphates, polyphosphates and phosphonates. Specific examples of inorganic phosphate builders include sodium and potassium tripolyphosphates, orthophosphates and hexametaphosphates. Preferably such inorganic phosphate builders are present at levels of not more than 5 wt % of the composition.

Other builders may also be included in the detergent composition of the invention if necessary or desired: suitable organic or inorganic water-soluble or water-insoluble builders will readily suggest themselves to the skilled detergent formulator. Inorganic builders that may be present include alkali metal (generally sodium) carbonate; while organic builders include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates; and organic precipitant builders such as alkyl- and alkenylmalonates and succinates, and sulphonated fatty acid salts.

Especially preferred supplementary builders are polycarboxylate polymers, more especially polyacrylates and acrylic/maleic copolymers, suitably used in amounts of from 0.5 to 15 wt % and monomeric polycarboxylates, more especially citric acid and its salts, suitably used in amounts of from 3 to 20 wt %.

Other Ingredients

It is desirable that the compositions according to the invention be approximately neutral or at least slightly alkaline, that is when the composition is dissolved in an amount to give surfactant concentration of 1 g/l in distilled water at 25° C. the pH should desirably be at least 7.5. For solid compositions the pH will usually be greater, such as at least 9. To achieve the required pH, the compositions may include a water-soluble alkaline salt. This salt may be a detergency builder (as described above) or a non-building alkaline material.

Apart from the components already mentioned, the detergent compositions of the invention may contain any of the conventional additives in amounts in which such materials are normally employed in fabric washing detergent compositions. Examples of these components include lather boosters such as alkanolamides, particularly the monoethanolamides derived from palm kernel fatty acids and coconut fatty acids, lather depressants such as alkyl phosphonates and silicones, anti-redeposition agents such as sodium carboxymethyl cellulose and alkyl or substituted alkyl cellulose ethers; heavy metal sequestrants such as ethylene diamine tetraacetic acid and the phosphonic acid derivatives (ie Dequest$^R$ types), fabric softening agents such as fatty amines, fabric softening clay materials; inorganic salts such as sodium and magnesium sulphate; and, usually present in very small amounts, fluorescent agents, perfumes, enzymes such as cellulases, lipases, amylases and oxidases, germicides, colourants or coloured speckles and pigments.

Other optional, but highly desirable components ingredients which may be employed in the detergent composition of the invention include polymers containing carboxylic or sulphonic acid groups in acid form or wholly or partially neutralised to sodium or potassium salts, the sodium salts being preferred.

Preferably the polymeric material is present at a level of from 0.1 to about 3% by weigh and has a molecular weight of from 1000 to 2,000,000 and may be a homo- or co-polymer of acrylic acid, maleic acid or salt or anhydride thereof, vinyl pyrrolidone, methyl or ethyl-vinyl ethers and other polymerisable vinyl monomers. especially preferred materials are polyacrylic acid or polyacrylate, polymaleic acid/acrylic acid coplymer; 70:30 acrylic acid/hydroxyethyl maleate copolymer, 1:1 styrene/maleic acid coplymer; isobutyleneimaleic acid and diisobutylene/maleic acid copolymers; methyl- and ethyl-vinylether/maleic acid copolymers; ethylene/maleic acid copolymer; polyvinyl pyrrolidone; and vinyl pyrrolidone/maleic acid copolymer. Other polymers which are especially preferred for use in liquid detergent compositions are deflocculating polymers such as for example disclosed in EP 346995.

It may also be desirable to include in the detergent composition of the invention an amount of an alkali metal silicate, particularly sodium ortho-, meta- or preferably neutral or alkaline silicate, at a level of, for example, of 0.1 to 10 wt %.

The cationic peroxyacids of the present invention may be used in a variety of product forms including powders, on sheets or other substrates, in pouches, in tablets or in non-aqueous liquids, such as liquid nonionic detergent compositions.

When incorporated in a bleach and or detergent bleach composition the cationic peroxyacids will preferably be in the form of particulate bodies comprising said cationic peroxyacid and a binder or agglomerating agent. In such a form the cationic peroxycid is more stable and easier to handle.

Many diverse methods for preparing such particulates have been described in various patents and patent applications such as, for example, GB 1,561,333; U.S. Pat. No. 4,087,369; EP-A-0,240,057; EP-A-0,241,962; EP-A-0,101,634 and EP-A-0,062,523, all of which are incorporated herein by reference. Any one of the methods described therein may be selected and used for preparing particulates comprising cationic acids of the invention.

When used in a detergent bleach composition, particulates incorporating the cationic peroxyacids of the invention are normally added to the base detergent powder in a dry-mixing process. However, it will be appreciated, the detergent base powder composition to which the peroxyacid particles are added may itself be made by any one of a variety of methods, such as spray-drying, high energy mixing/granulation, dry-mixing, agglomeration, extrusion, flaking etc. Such methods are well known to those skilled in the art and do not form part of the present invention.

The cationic peroxyacids of the present invention may also be incorporated in detergent additive products. Such additive products are intended to supplement or boost the performance of conventional detergent compositions and may contain any of the components of such compositions, although they will not comprise all of the components present in a fully formulated detergent composition. Such additive products containing, for example, up to 90% by weight of the cationic peroxyacid and a surface active material maybe particularly useful in hygiene applications eg hard surface cleaners.

Additive products in accordance with this aspect of the invention may comprise the cationic peroxyacid alone or in combination with a carrier, such as a compatible particulate substrate, a flexible non-particulate substrate or a container (e.g. pouch or sachet).

Examples of compatible particulate substrates include inert materials, such as clays and other aluminosilicates, including zeolites both of natural and synthetic of origin. Other compatible particulate carrier substrates include hydratable inorganic salts, such as phosphates, carbonates and sulphates.

Additive products enclosed in bags or containers can be manufactured such that the bags/containers prevent egress of their contents when dry but are adapted to release their contents on immersion in an aqueous solution.

The invention is further illustrated by way of the following non-limiting examples in which parts and percentages are by weight unless indicated otherwise.

In the Examples, the following abbreviations are used:

Na-PAS: sodium salt of primary alkyl sulphate

Nonionic 7EO: nonionic surfactant; $C_{12}$–$C_{14}$ ethoxylated alcohol containing an average of 7 ethylene oxide group per molecule, ex ICI Nonionic 3EO: nonionic surfactant; $C_{12}$–$C_{14}$ ethoxylated alcohol containing an average of 3 ethylene oxide groups per molecule, ex ICI Soap: sodium salt of stearic acid Zeolite A 24: crystalline sodium aluminosilicate, ex Crosfield EDTA: ethylene diamine tetraacetate

EXAMPLE 1

Preparation of a 6-N-Octyl,N,N'-dimethyl ammoniumperoxyhexanoic acid tosylate (or $C_8$-tosylate)

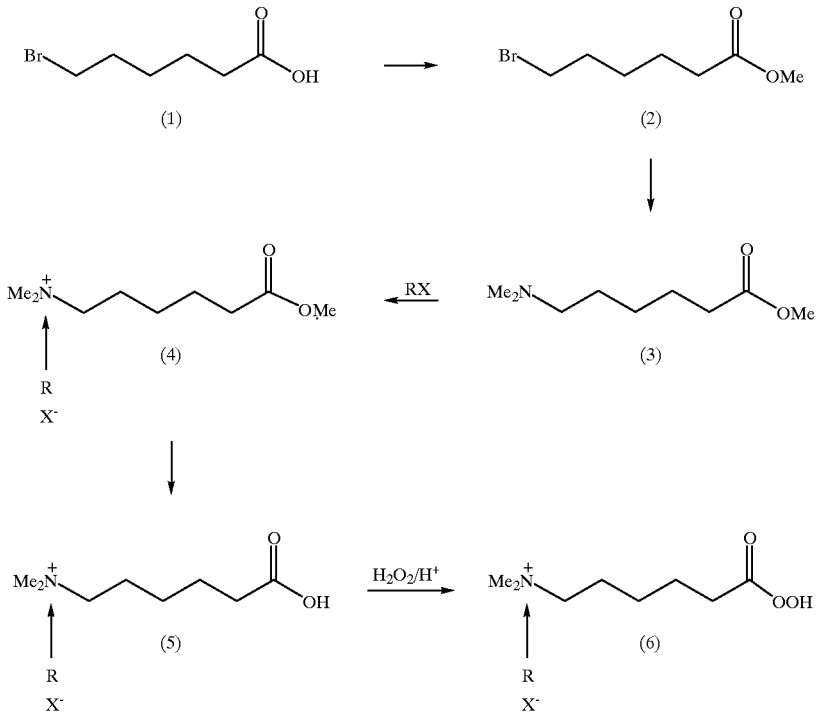

Bromohexanoic acid (1) (40 g, 0.2 m) was dissolved in methanol (150 ml) and to this solution was added toluene sulphonic acid (0.2 g). The mixture was heated under reflux for 8 hours.

The solvent was removed under reduced pressure and the oil was dissolved in ether (300 ml) and washed with sodium bicarbonate solution (100 ml), water (100 ml) and brine (100 ml). The ethereal layer was then dried over magnesium sulphate, filtered and evaporated to dryness to give a yellow oil identified as methyl-6-bromohexanoate (2) (41.6 g, yield=97%).

Analysis by GLC=98%; ($\delta CDCl_3$) 3.7,s, 3H C $\underline{H}_3$OOC;3.4,t,2H Br$C\underline{H}_2$;2.35,t,2H $C\underline{H}_2$COO,1.9,m, 2H Br$CH_2C\underline{H}_2$;1.7,m,2H $C\underline{H}_2CH_2$COO;1.5,m,2H C $\underline{H}_2CH_2CH_2$COO.

This methyl-6-bromohexanoate (2) (20.9 g, 0.1 m) was added to a solution of dimethylamine (33% in ethanol, 100 ml) and the mixture was heated under reflux for a period of 3 hours. The solvents were removed under reduced pressure to yield an oil which was dissolved in water (50 ml) Sodium hydroxide was added (4 g, 0.1m) and the mixture extracted with ether (4×100 ml). The combined ethereal layers were washed with brine and dried over magnesium sulphate. The ether was filtered and concentrated under reduced pressure to yield an oil identified as methyl-6-dimethylamonohexanoate (3) (15.5 gr).

Analysis by GLC 60% methyl,35% methyl esters. ($\delta CDCl_3$) 4.1,q,2H $C\underline{H}_2$OCO;3.7,s,3H C $\underline{H}_3$OOC2.2–2.35,m,4H $C\underline{H}_2NMe_2$+$C\underline{H}_2$COO, 2.2,s, 6H N $\underline{Me}_2$;1.9;1.65,M,2H $C\underline{H}_2CH_2$COO;1.48,m, 2H $NMe_2CH_2$C $\underline{H}_2$; 1.35,M,2H $C\underline{H}_2CH_2CH_2$COO;1.2,M,3H $C\underline{H}_3CH_2$OCO.

This methyl-6-dimethylaminohexanoate (3) (8 g, 0.046 m) was dissolved in acetonitrile (100 ml) and octyltosylate (17.3 g, 0.05 m) was added. The mixture was heated under reflux for a period of 5 hours. The solution was evaporated to dryness, then ether (500 ml) was added and a precipitate formed which was separated and further triturated with ether (2×100 ml) and dried in vacuo to give a white solid identified as methyl-6N-octyl,N,N'-dimethyl ammonium-hexanoate tosylate (4) (18.7 g, 87% yield). ($\delta D_2O$)7.4,d,2H Ar—H; 7.7,d,2H Ar—H; 3.7,s, 3H $C\underline{H}_3$OCO;3.25,m,4H C $\underline{H}_2N^+Me_2C\underline{H}_2$;3.05,s,6H $\underline{Me}_2N^+$;2.45,t,2H OCOC $\underline{H}_2$;2,41,s,3H Ar—$\underline{Me}$;1.7,m,6H $OCOCH_2C\underline{H}_2CH_2$C $\underline{H}_2CH_2N^+$+$N^+CH_2C\underline{H}_2$R;1,3–1.5,m,12H (C $\underline{H}_2)_5$+$OCOCH_2CH_2C\underline{H}_2CH_2CH_2N^+$; 0.9,t,3H $(CH_2)_9$—$CH_3$.

This tosylate (4) (14.8 g, 0.03 m) was dissolved in water (100 ml) and sulphuric acid (100 ml, 3% w/w) was added. This solution was heated under reflux for 10 hours. Upon cooling thereof, a white solid crystallised out of solution, was separated by filtration, washed with water and dried in vacuo (11 g, yield=77%).

($\delta D_2O$)7.2,d,2H Ar—H; 7.55,d,2H Ar—H; 3.2,m,4H C $\underline{H}_2N^+Me_2C\underline{H}_2$;3.0,s,6H $\underline{Me}_2N^+$;2.5,t,2H OCOC $\underline{H}_2$;2.41,s,3H Ar—Me; 1.65,m, 6H $OCOCH_2C\underline{H}_2CH_2$C $\underline{H}_2CH_2N^+$+$N^+CH_2C\underline{H}_2$R ;1.3–1.5,m,16H $(CH_2)_7$+ $OCOCH_2CH_2C\underline{H}_2CH_2CH_2N^+$; 0.9,t,3H $(CH_2)_7$—$C\underline{H}_3$.

This white solid was identified as methyl-6-N-octyl,N,N'-dimethylammoniumhexanoate tosylate (5).

This tosylate (5) (2.0 g, 00046 m) was dissolved in distilled methane sulphonic and (10 ml) and this solution was cooled to 2° C. with stirring while hydrogen peroxide (0.78 g, 80% solution, 5 times excess) was added dropwise over 10 minutes. This solution was stirred for 2 hours at 4° C. and then for two hours at room temperature (20° C.). This mixture was poured into water (200 ml) containing p-toluene sulphonic acid (15 g). The mixture was stirred and a white precipitate formed which was removed by filtration, washed with water and dried in vacuo. Peracid by titation= 93%. The white solid isolated (2.6 g, yield=87%) was identified as material (6).

'Hnmr Assay ($D_2O$/Trioxan)=96%; ($\delta D_2O$)7.3,d,2H Ar—H; 7.65,d,2H Ar—H; 3.2,m,4H $CH_2N^+Me_2C$ $\underline{H}_2$;3.0,,s,6H $\underline{Me}_2N^+$;2.4,t,2H $OCOC\underline{H}_2$;2,38,s,3H 3H Ar—Me; 1.55,m,6H $OCOCH_2C\underline{H}_2CH_2$C $\underline{H}_2CH_2N^+$+$N^+CH_2C\underline{H}_2$R ;1.2–1.4,m,12H (C $\underline{H}_2)_5$+$OCOCH_2CH_2C\underline{H}_2CH_2CH_2N^+$0.9,t, 3H $(CH_2)_7$—C $\underline{H}_3$.

EXAMPLE 2,3,4, Comparative Example A

In these Examples, bleaching experiments were carried out using the following particulate detergent base composition:

| | (% by weight) |
|---|---|
| Na-PAS | 6.35 |
| Nonionic 7EO | 6.35 |
| Nonionic 3EO | 8.19 |
| Soap | 2.33 |
| Zeolite A24 (anhydrous) | 40.66 |
| Sodium carbonate | 24.71 |
| Sodium silicate | 5.18 |
| EDTA | 0.20 |
| Moisture | 6.03 |

The bleaching experiments were carried out in a temperature-controlled glass vessel, equipped with a magnetic stirrer, thermocouple and a pH-electrode, at a constant temperature of 40° C.

The detergent base composition illustrated above was added to 100 ml demineralised water in the glass vessel, to obtain a concentration of said base composition of 5 g/l.

Subsequently, the peroxyacid prepared according to Example 1 ($1\times10^{-3}$M) was added to the thus obtained solution in the glass vessel. Thereafter, tea-stained (BC-1) test cloths were immersed in the solution for 30 minutes. The liquor to cloth ratio was greater than 20:1. After rinsing with tap water, the cloths were dried in a tumble drier.

In addition, two further peroxyacid according to the invention, i.e. 6-N-Dodecyl, N,N'-dimethylammoniumperoxy hexanoic acid tosylate (or $C_{12}$-tosylate) and 6-N-Decyl,N,N'-dimethylammoniumperoxy hexanoic acid tosylate (or $C_{10}$-tosylate) were tested, using this method and applying the same concentrations for the peroxyacid and the base composition.

For reasons of comparison, a peroxyacid having a structure outside the range claimed by the present invention, i.e. methyl-6-N-tetradecyl,N,N'-dimethylammoniumperoxyhexanoic acid tosylate (or $C_{14}$-tosylate) was also tested, using the above method and concentrations.

The bleaching performance of all peroxyacids tested was determined, using an Instrumental Colour Systems Micromatch to measure the reflectance, at 460 nm, of the cloths both before and after treatment. The difference ($\Delta R_{460}$)in the values gives a measure of the effectiveness of the treatment. The results in terms of this reflectance difference, are given below:

| Example | Peroxyacid | $\Delta R_{460}$. |
|---|---|---|
| 2 | $C_8$-tosylate | 18.3 |
| 3 | $C_{10}$-tosylate | 12.2 |
| 4 | $C_{12}$-tosylate | 6.7 |
| A | $C_{14}$-tosylate | 1.0 |

It can be seen that the peroxyacid compounds of the invention give a considerably better bleaching performance when applied in the presence of the anionic surfactants (Na-PAS) containing base composition, than the peroxyacid compound of comparative Example A having a structure just outside the range claimed by the present invention.

We claim:

1. Cationic organic peroxyacid having the general formula

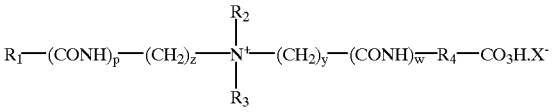

wherein:

$R_1$ is an optionally substituted, linear or branched, $C_8$ alkyl or alkenyl group, $R_2$ and $R_3$ are each a methyl group;

$R_4$ is an optionally substituted, linear or branched $C_5$ alkyl or alkenyl group;

p is 0 or 1; z is an integer selected from 0–3;

y is an integer selected from 0–5; w is 0 or 1; and $X^-$ is a counter anion.

2. Peroxyacid according to claim 1, wherein p, z, y, and w are all 0.

3. Peroxyacid according to claim 1, wherein $R_1$ is an unsubstituted linear $C_8$ alkyl group.

4. Peroxyacid according to claim 1, wherein $R_4$ is an unsubstituted, linear $C_5$ alkyl group.

5. Peroxyacid according to claim 1, wherein $X^-$ is selected from the group consisting of $NO_3^-$, $HSO_4^-$, $SO_4^{2-}$, $CH_3SO_4^-$, and $R_5$ $(O)_p$ $SO_3$, wherein $R_5$ is a $C_2$–$C_{20}$ substituted or unsubstituted radical selected from the group consisting of alkyl, alkenyl, and aryl group, and p is 0 or 1.

6. Peroxyacid according to claim 5, wherein $X^-$ is selected from sodium dodecyl sulphate (SDS), sodium fatty acid alpha sulphonate (SFAS) and tosylate.

7. Bleaching detergent composition, comprising from 3 to 40% by weight of one or more surface-active compounds, from 5 to 80% by weight of one or more detergency builders and an effective amount of a cationic peroxyacid according to claim 1, as the bleach component.

8. Composition according to claim 5, wherein the cationic peroxyacid is present at a concentration of from 0.5 to 15% by weight.

9. Bleaching additive composition, comprising from 50 to 90% by weight of a cationic peroxyacid according to claim 1, as the bleach component.

* * * * *

UNITED STATES PATENT AND TRADEMARK OFFICE

CERTIFICATE OF CORRECTION

PATENT NO. : 5,908,820

DATED : June 1, 1999

INVENTOR(S) : Oakes et al.

It is certified that error appears in the above-indentified patent and that said Letters Patent is hereby corrected as shown below:

On the title page, item [73] Assignee:

Change "Lever Brothers Company," to

-- Lever Brothers Company, Division of Conopco, Inc. --

Signed and Sealed this

Eighteenth Day of January, 2000

*Attest:*

*Attesting Officer*

Q. TODD DICKINSON

*Commissioner of Patents and Trademarks*